US007647745B2

(12) United States Patent
Kames

(10) Patent No.: US 7,647,745 B2
(45) Date of Patent: Jan. 19, 2010

(54) ADJUSTABLE TRANSMISSION CHANNEL FOR A MEDICATION DISPENSING APPARATUS

(75) Inventor: Edward David Kames, Tarpon Springs, FL (US)

(73) Assignee: MTS Medication Technologies, Inc., St. Petersburg, FL (US)

( * ) Notice: Subject to any disclaimer, the term of this patent is extended or adjusted under 35 U.S.C. 154(b) by 0 days.

(21) Appl. No.: 11/611,794

(22) Filed: Dec. 15, 2006

(65) Prior Publication Data

US 2008/0142402 A1 Jun. 19, 2008

(51) Int. Cl.
*B65B 5/00* (2006.01)
*B65B 35/54* (2006.01)

(52) U.S. Cl. ..... 53/257; 53/539

(58) Field of Classification Search ..... 53/147, 53/539, 257, 260, 261, 262, 263; 193/2 C
See application file for complete search history.

(56) References Cited

U.S. PATENT DOCUMENTS 4,377,230 A * 3/1983 Burkner ..... 198/525
5,375,342 A * 12/1994 Giesler ..... 34/168
5,551,217 A * 9/1996 Huening et al. ..... 53/474
5,765,606 A * 6/1998 Takemasa et al. ..... 141/104
6,023,916 A * 2/2000 Bouthiette ..... 53/471
6,186,731 B1 * 2/2001 Vickers et al. ..... 414/519
7,032,378 B2 * 4/2006 Ioku et al. ..... 60/424
7,412,811 B2 * 8/2008 Marcus et al. ..... 53/432

* cited by examiner

*Primary Examiner*—Rinaldi I. Rada
*Assistant Examiner*—John Paradiso
(74) *Attorney, Agent, or Firm*—Robert J. Depke; Rockey, Depke & Lyons, LLC

(57) ABSTRACT

At least one movable interlocking sidewall structure provides alteration of the physical dimensions for a solid pharmaceutical or nutraceutical temporary storage cavity and/or transmission channel. Preferably a plurality of interlocking sidewall structures are simultaneously adjusted so that an array of cavities and/or transmission channels may have their physical dimensions simultaneously altered by the mechanical action of a drive member. Advantageously the adjustment of the structure provides a more suitable space within which a solid pharmaceutical or nutraceutical product may be temporarily stored or transferred.

10 Claims, 8 Drawing Sheets

ADJUSTABLE TRANSMISSION CHANNEL FOR A MEDICATION DISPENSING APPARATUS

BACKGROUND OF THE INVENTION

1. Field of the Invention

The present invention generally relates to medication package filling systems and methods and more specifically to adjustable transmission channels used in connection with the medication filling apparatus.

2. Description of the Related Art

Solid medication is often packaged in disposable packages which include cavities for retaining individual doses of medication. Automated devices are used to fill these packages. Typically, a package is arranged into an array of individual cavities and a plurality of transmission channels are provided in one-to-one correspondence with the individual cavities of the package.

One problem associated with using conventional automated solid pharmaceutical packaging systems is that typically a wide variety of different sized medication is packaged using the same apparatus. The solid pharmaceutical and nutraceutical transmission channels of the packaging apparatus are typically used for small pills capsules and tablets which may vary substantially in their respective the physical dimensions. In some instances, for example, when placing elongated capsules in the package, it is necessary to ensure that the transmission channel from the dispensing mechanism or hopper to the package is sufficiently sized to ensure that the elongated capsule does not become stuck. Additionally, when filling package cavities with small pills, it is necessary to ensure that the transmission channel for the small pills is properly aligned with the cavity so that the small pills are properly transmitted to the appropriate package cavity location. Because of the size differences, it is often difficult to utilize a single transmission channel for packaging solid pharmaceutical and nutraceutical products. This is particularly true because it may be preferred to have a certain pill orientation when utilizing certain pill packaging machinery. For example, when packaging elongated capsules, it may be desired to maintain a generally vertical orientation for the capsules.

Currently, none of the conventional solutions adequately address each of the design concerns associated with the various physical dimensions for the pills capsules and tablets that are typically packaged with an automated packaging device. Accordingly, there remains a need in the field for an improved solid pharmaceutical and nutraceutical transmission channel for use in conjunction with automated packaging systems.

OBJECTS AND SUMMARY OF THE INVENTION

It is therefore one object and advantage of the present invention to provide an adjustable transmission channel for use in connection with the automated packaging of a variety of sizes of medication;

Another object of the present invention is to provide an adjustable transmission channel having internal physical dimensions which may be altered as desired for the purpose of packaging solid pharmaceuticals and nutraceuticals of various shapes and sizes. It is a further object of the present invention to provide an adjustable solid pharmaceutical and nutraceutical transmission channel which may be conveniently adjusted.

In accordance with the present invention, a temporary storage structure includes a plurality of cavities which are also referred to as adjustable transmission channels. Advantageously, the physical dimensions of the cavities or transmission channels may be adjusted for the purpose of providing more suitable or preferred dimensions for the temporary storage cavities and/or transmission channels that are used in conjunction with an automated packaging system.

In a preferred exemplary embodiment of the present invention, the adjustable transmission channels and/or temporary storage mechanisms of the present invention include an outer frame member and a top cover plate having a plurality of openings formed therein. It is preferred that the openings in the top cover plate have a tapered portion located above each cavity or transmission channel which is used to direct a solid pharmaceutical or nutraceutical product into the adjustable cavity and/or transmission channel located therebelow.

The adjustable transmission channel is preferably formed by first and second interlocking structures that define the sidewalls of the adjustable transmission channel and/or temporary storage structures of the present invention. Advantageously, moving the first and second interlocking structures together or apart causes alteration of the physical cavities defined by the interlocking sidewalls. This adjustment may be used to achieve a more suitable cavity and/or transmission channel for the solid pharmaceutical and/or nutraceutical products that are processed with an automated packaging system.

In a preferred exemplary embodiment, a pneumatic drive or screw drive is provided for the purpose of applying pressure against at least one of the adjustable portions which may be biased against this motion by a spring or similar such structure. Those of ordinary skill in the art will recognize that virtually any type of mechanical or electromechanical drive may be utilized for the purpose of adjusting the physical dimensions of the cavities and/or transmission channels. Specifically, hydraulic drives, pneumatic drives screw drives or solenoid drives may also be provided for the purpose of adjusting the physical dimensions of the cavities by pushing against at least one of the portions defining the interlocking sidewalls of the cavities. As noted, springs or other members may be provided to push outward against the force of the drive mechanism. Those skilled in the art will appreciate that the inward pressure that is applied against one or more of the interlocking structures may be substituted with an outward motion for the mechanical drive when spring bias or other mechanical bias is provided in an inward direction.

Other objects and advantages of the present invention will be apparent in light of the following Detailed Description of the Presently Preferred Embodiments.

BRIEF DESCRIPTION OF THE DRAWINGS

The features of the present invention which are believed to be novel are described in detail herein below. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE PREFERRED EMBODIMENTS

Figure 1:
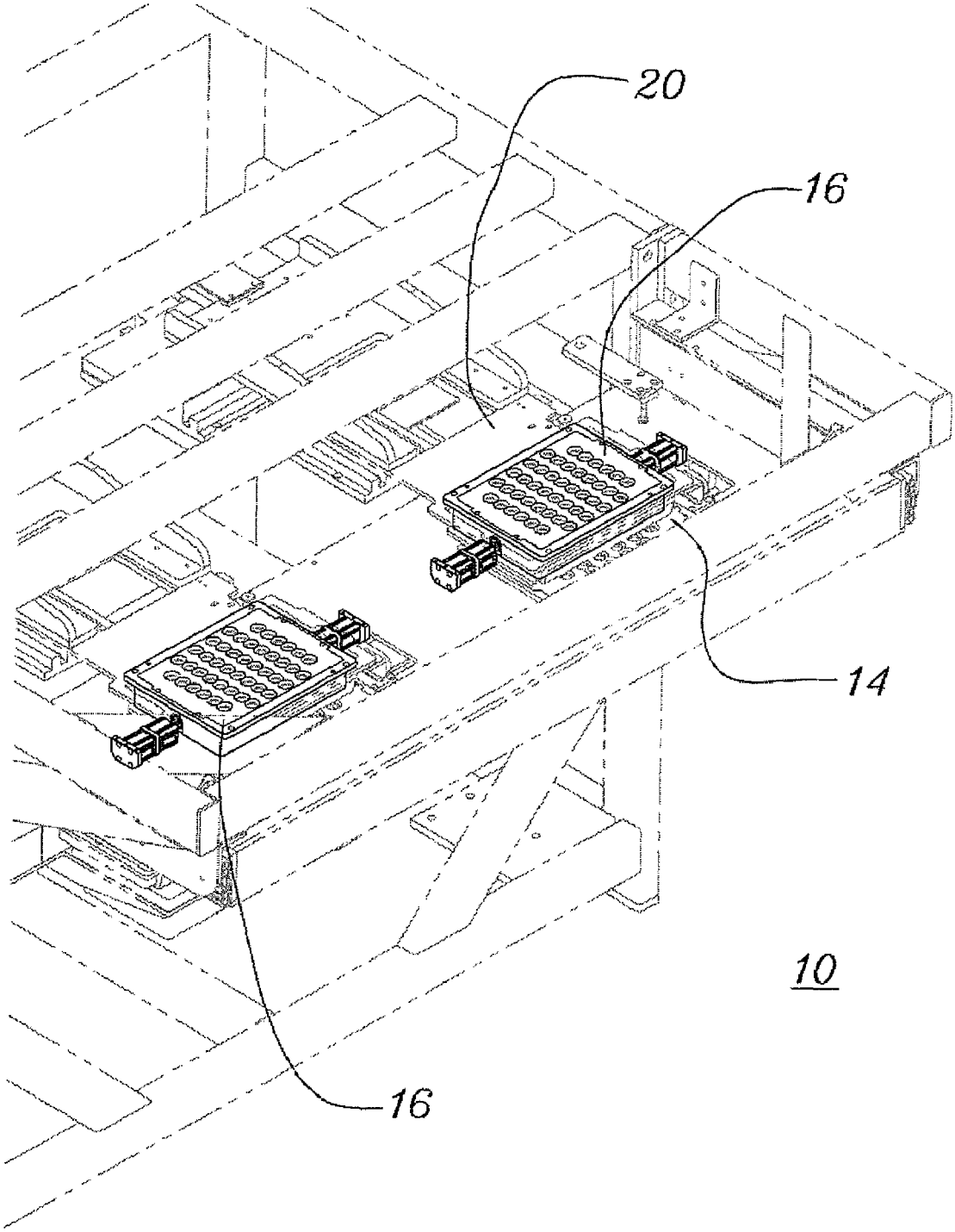
FIG. 1 is a perspective view of a medication package filing apparatus which includes the adjustable transmission channels and/or cavities of the present invention.

While the invention may be susceptible to embodiment in different forms, there are shown in the drawings and will be described herein in detail, specific embodiments with the understanding that the present disclosure is to be considered an exemplification of the principles of the invention, and is not intended to limit the invention to that as illustrated.

An automated medication package filling apparatus shown generally at 10 in FIG. 1 utilizes the adjustable solid pharmaceutical and nutraceutical transmission channel of the present invention. The automated filling mechanism that is shown generally at 10 includes two structures embodying the adjustable transmission channels or cavities 14 and 16 which are described in more detail below. The automated solid pharmaceutical and nutraceutical filling mechanism that is illustrated generally at 10 may be embodied as, for example, one of the automated filling mechanisms described in any of the typical conventional automated filling systems which are exemplified by the systems described in U.S. patent application Ser. No. 11/269,781 filed on Nov. 8, 2005 entitled Automated Solid Pharmaceutical Packaging Machine Utilizing Robotic Drive. This previously filed application is incorporated herein by reference and the disclosure of the referenced previously filed application should be considered part of the instant application.

Additionally, the system described in this application can be utilized with the automated packaging system described in application Ser. No. 09/539,834 filed on Mar. 30 1, 2000, titled Automated Solid Pharmaceutical Product Packaging Machine. This previously filed application is incorporated herein by reference and the disclosure of the referenced previously filed application should be considered part of the instant application. Furthermore, the system described in this application can be utilized with the automated packaging system described in application Ser. No. 09/704,134 filed on Nov. 1, 2000, titled Automated Solid Pharmaceutical Product Packaging Machine. This previously filed application is incorporated herein by reference and the disclosure of the referenced previously filed application should be considered part of the instant application. The system of the instant application can also be used with the systems and methods described in now issued U.S. Pat. No. 6,508,279 which is also incorporated herein by reference. Those skilled in the art will also appreciate that the systems and methods described in the instant application can also be used with a variety of other automated packaging systems so that a desired transmission cavity or temporary storage location size can be dynamically altered as desired.

Those of ordinary skill in the art will recognize that the adjustable transmission channels of the present invention may be used in other solid pharmaceutical and nutraceutical filling systems. It should also be recognized that the adjustable transmission channels may be temporarily stacked to provide an intermediate storage of a solid pharmaceutical or nutraceutical product as described in patent application Ser. No. 09/704,134. For example, when utilized in such a system, a shuttle mechanism may be provided for temporarily moving one of the adjustable cavity structures beneath another for the purpose of receiving solid products from the upper structure. This is accomplished by alignment of the upper and lower cavities when desired for selectively dropping the solid pharmaceutical or nutraceutical products.

As described in some of the above-referenced earlier filed patent applications, the structures embodying the upper and lower adjustable transmission channels or cavities 14 and 16 may be operatively connected to an X-Y drive mechanism 20 which may be utilized to advantageously position one of the adjustable transmission channels 16 or cavities beneath a dispensing a funnel (not shown) positioned above the adjustable transmission channels and/or cavities such as the member 16. Such an arrangement is described in earlier filed application Ser. No. 09/704,134 which is incorporated herein by reference.

In one embodiment, the upper structure 16 having adjustable transmission channels or cavities initially has its cavities filled and medication received by the upper adjustable transmission channels or cavities 16 is deposited into the adjustable transmission channels or cavities of the lower structure 14. In the preferred exemplary embodiment, the medication remains in the lower structure having the adjustable transmission channels or cavities 14 until a further temporary storage member receives the medication from the lower structure 14 and places the medication into the product package (not shown).

By placing a medication in the upper structure 16 having the adjustable transmission channels or cavities first, filling of the upper adjustable transmission channel 16 can occur while the medication is being transferred from the lower structure 14 to a temporary storage member and ultimately to the product package. In this manner higher throughput can be achieved.

Figure 2:
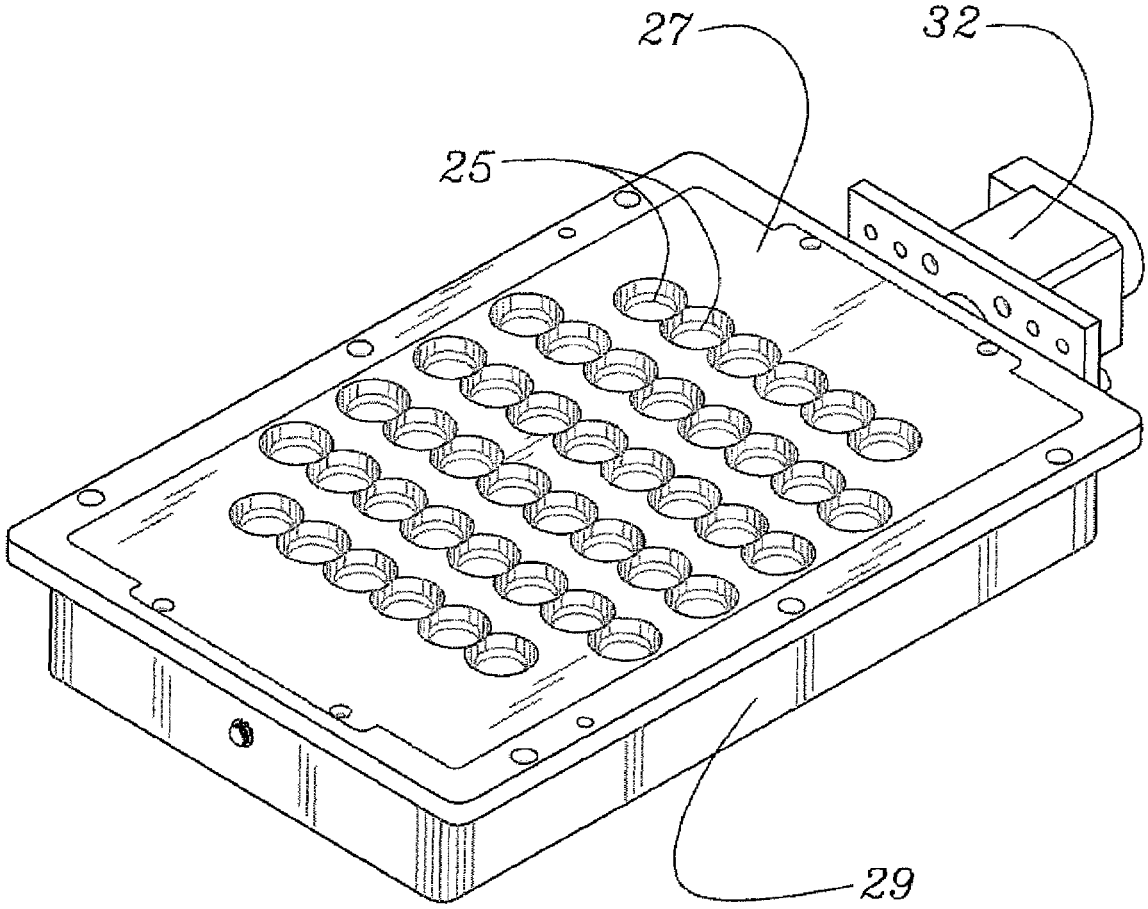
FIG. 2 is a perspective view of the adjustable transmission channels and/or cavities of the present invention.
Figure 3:
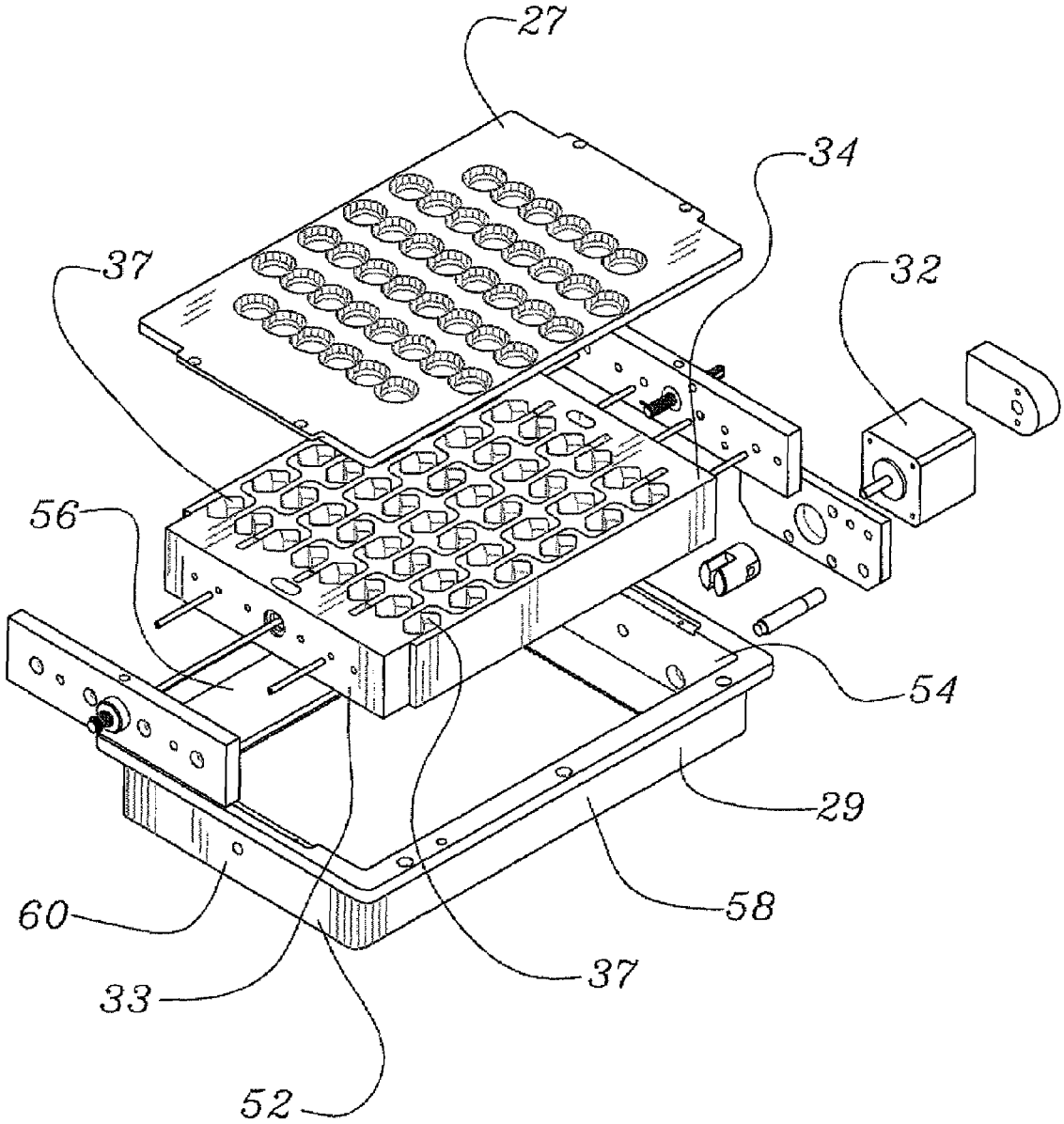
FIG. 3 is an exploded perspective view of the adjustable transmission channels and/or cavities of the present invention.

One of the structures 14, 16 having the adjustable transmission channels or cavities is shown in more detail in FIGS. 2-9. For example, as shown in FIG. 2, a plurality of adjustable temporary storage cavities or transmission channels are preferably provided in one to one correspondence with openings 25 formed in a top cover plate 27 that is secured over a perimeter frame body 29. FIG. 2 also illustrates the mechanical drive structure 32 which is used for altering the physical dimensions of the solid pharmaceutical and nutraceutical temporary storage cavities and/or transmission channels. FIG. 3 illustrates the structures which may be used for providing the adjustable transmission channels and or temporary storage cavities of the present invention. A perimeter frame support 29 is provided for securing various other components to provide the adjustable channels and/or cavities of the present invention.

The perimeter frame support 29 is illustrated as a unitary body which may be comprised of, for example, a durable plastic, or aluminum, those of ordinary skill in the art will recognize that the frame may be embodied as several different portions which are secured to provide support for the adjustable cavity portions. It should also be recognized that other types of supports may be provided for adjustably securing one or more members that define the adjustable cavities and/or transmission channels of the present invention.

FIG. 3 also illustrates the interlocking sidewall structures 33, 34 which define the adjustable transmission channels and/or cavities of the present invention. The relative horizontal displacement between these two interlocking structures 33 and 34, results in the alteration of the cavities and/or transmission channels that are located beneath the openings defined in the cover plate 27. The motor drive 32 of FIG. 3 is used for applying pressure to move at least one of the interlocking structures 33, 34 horizontally so that the physical dimensions of the cavities and/or transmission channels may be adjusted. All that is necessary is that one structure move relative to the other for the purpose of altering the physical dimensions of the cavities defined by the structures. Those skilled in the art will appreciate that the motor can push against one structure via a threaded engagement, for example or both structures by turning an appropriately threaded drive when there are corresponding threaded portions secured to or embodied within the adjustable structures.

The frame 29 is generally rectangularly-shaped and includes a first end wall 52, a second end wall 54 generally parallel to the first end wall 52, and two side walls 56, 58 extending between the first and second end walls 52, 54 and generally perpendicular to the first and second end walls 52, 54. A pin aperture 60 is provided through each end wall 52, 54 at approximately the center thereof for the purpose of providing alignment of the structures.

Figure 4:
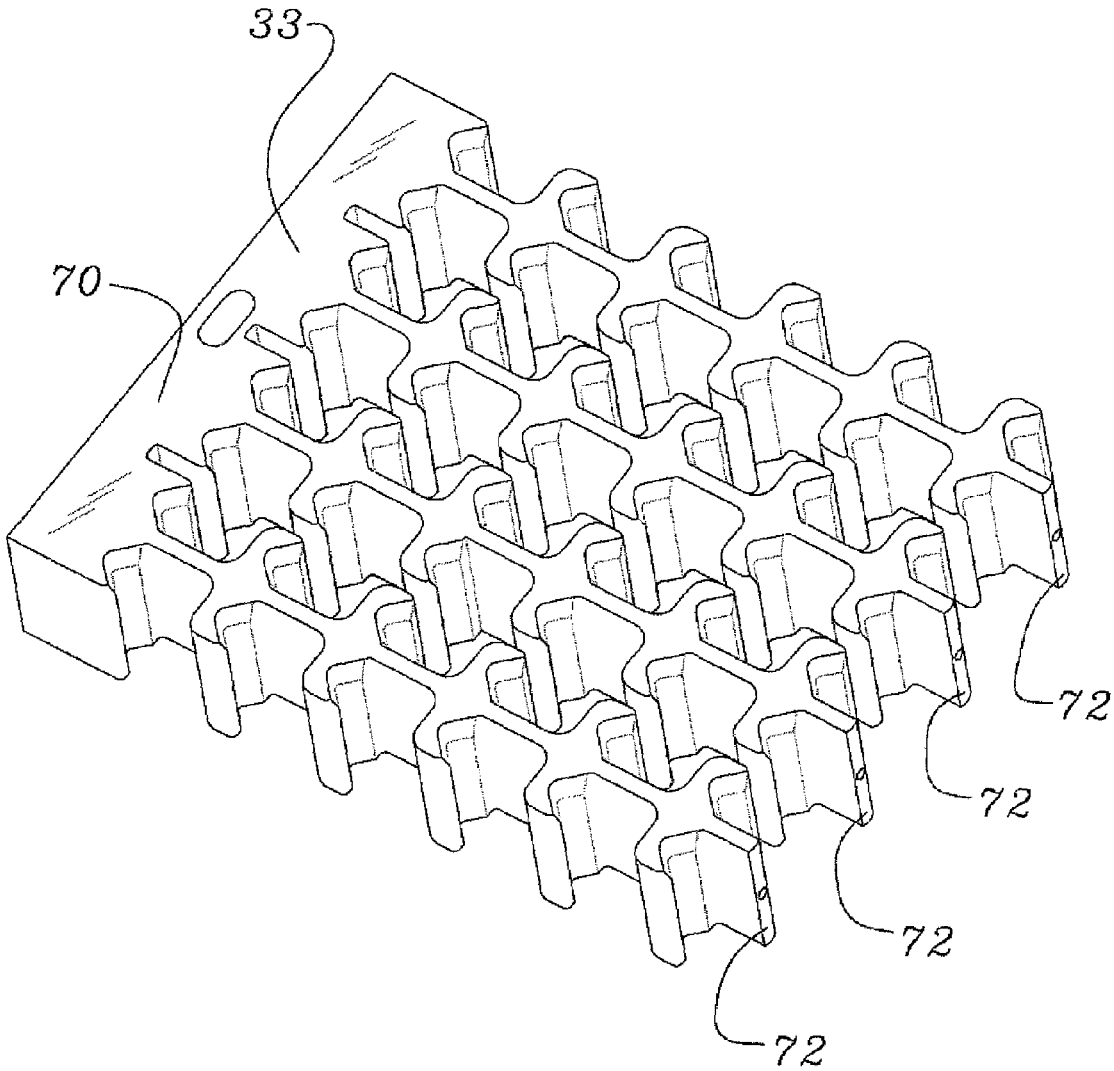
FIG. 4 is a perspective view of a first portion of the adjustable transmission channels and/or cavities.

FIG. 4, illustrates the first interlocking sidewall portion 33 which defines the variably sized temporary storage cavities and/or transmission channels 37. The interlocking sidewall portion 33 includes an elongated base member 70 and four arms 72 extending therefrom generally perpendicular to the base member 70. Each arm 72 includes a plurality of interlocking side wall surfaces 74 extending generally perpendicular to each arm 72. Internal surfaces 74 of each arm 72 are generally curved walls.

Figure 5:
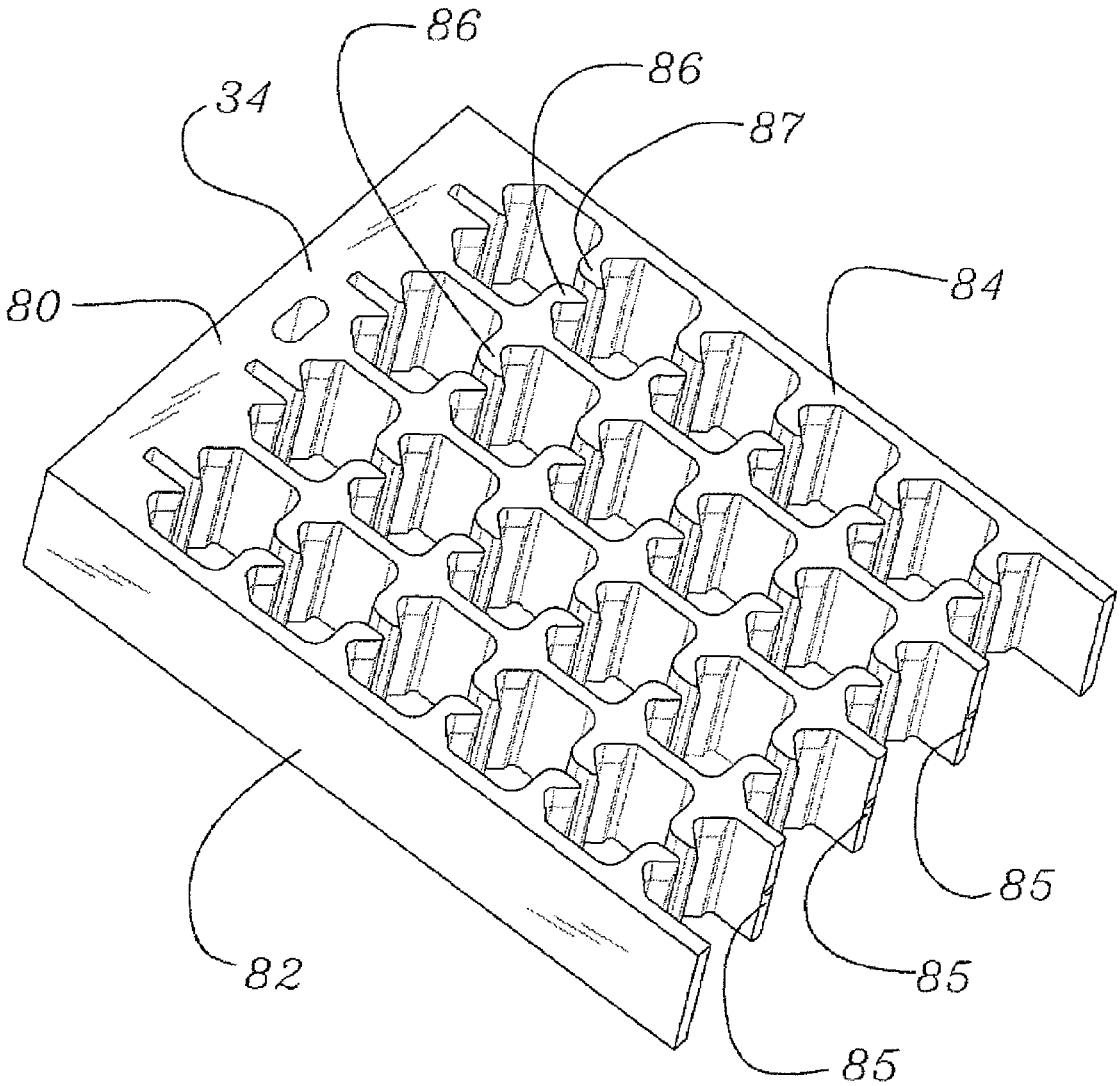
FIG. 5 is a perspective view of a second portion of the adjustable transmission channels and/or cavities.

FIG. 5 illustrates in more detail the interlocking sidewall structure 34 which mates with the interlocking sidewall structure 33 that is described in detail with respect to FIG. 4. As shown in FIG. 5, a supporting base wall 80 includes a first external sidewall 82 and a second external sidewall 84. A plurality of arms 85 extend from the central portion of the base wall 80. Each arm 85 includes interlocking sidewall surfaces 86, which extend generally perpendicularly outward from the arms 85. Similarly, the external sidewalls 82 and 84 provide interlocking sidewall surfaces 87 which extend inward from the external sidewalls. The interlocking bodies described with reference to FIGS. 4 and 5 are preferably comprised of machined aluminum and may be alternately embodied as a molded hard plastic structure.

Those skilled in the art will readily appreciate that any a suitable material may be used for forming the interlocking bodies provided that they have adequate strength for the purpose of defining the cavities and that they may provide the desired reliability for the product. It should also be recognized that the various interlocking sidewall structures may be machined to provide a resultant cavity having a desired range of dimensions. Adjustment of the cavity and/or transmission channel size can readily be accomplished by adjusting the spacing of the various interlocking structures as described below.

Figure 6:
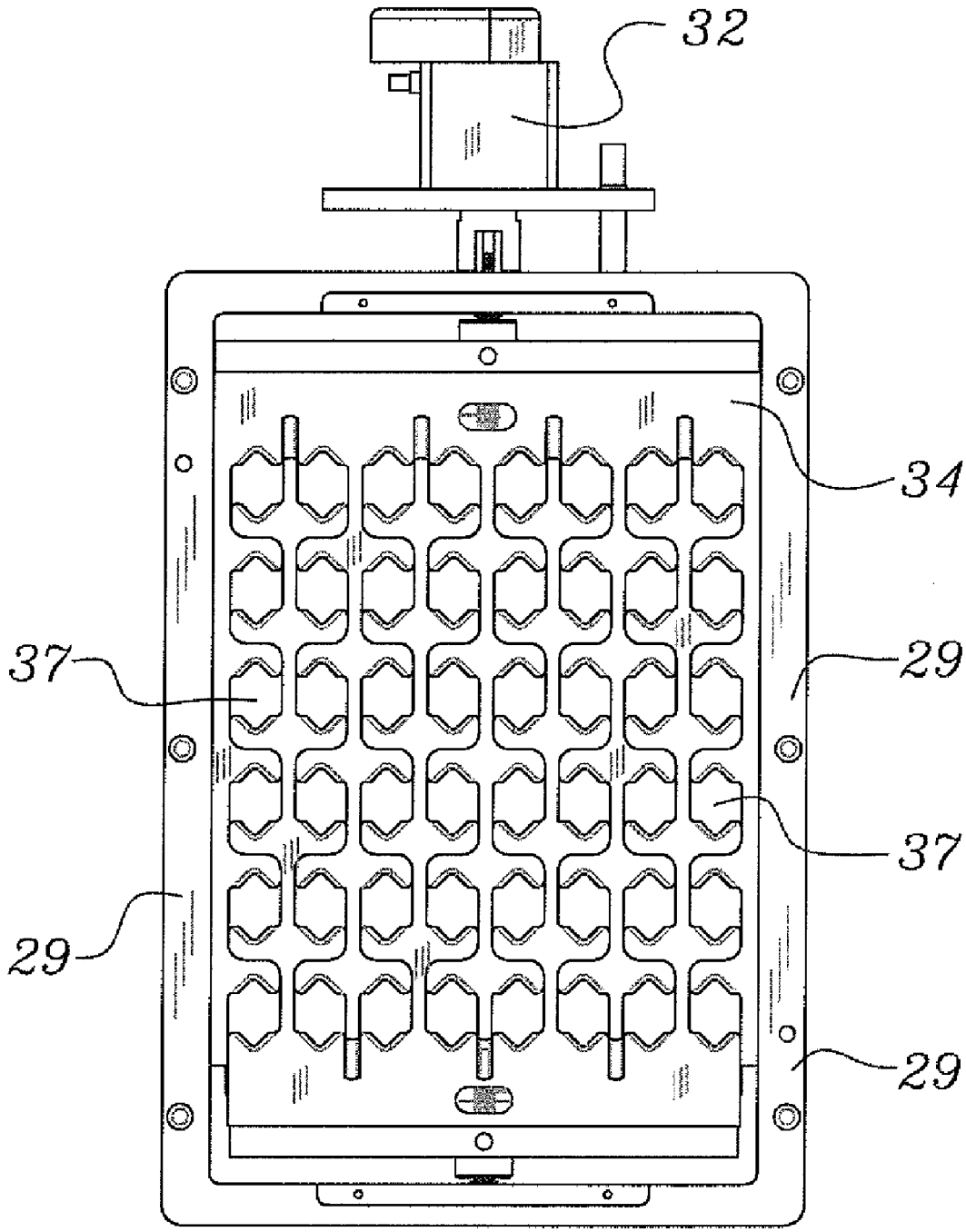
FIG. 6 is an elevated view of the adjustable transmission channels and/or cavities of the present invention shown partially in cross-section.

FIG. 6 illustrates the interlocking sidewall members 33, 34 secured within frame 29 wherein the interlocking sidewall members are adjusted to provide a larger internal cavity dimension for the cavities 37. The spacing between the inner side walls of the interlocking sidewall members 33, 34 is adjusted by drive motor 32 which in the preferred exemplary embodiment is a screw type drive mechanism which provides inward and outward motion of the interlocking sidewall member 34 with respect to interlocking sidewall member 33.

Figure 7:
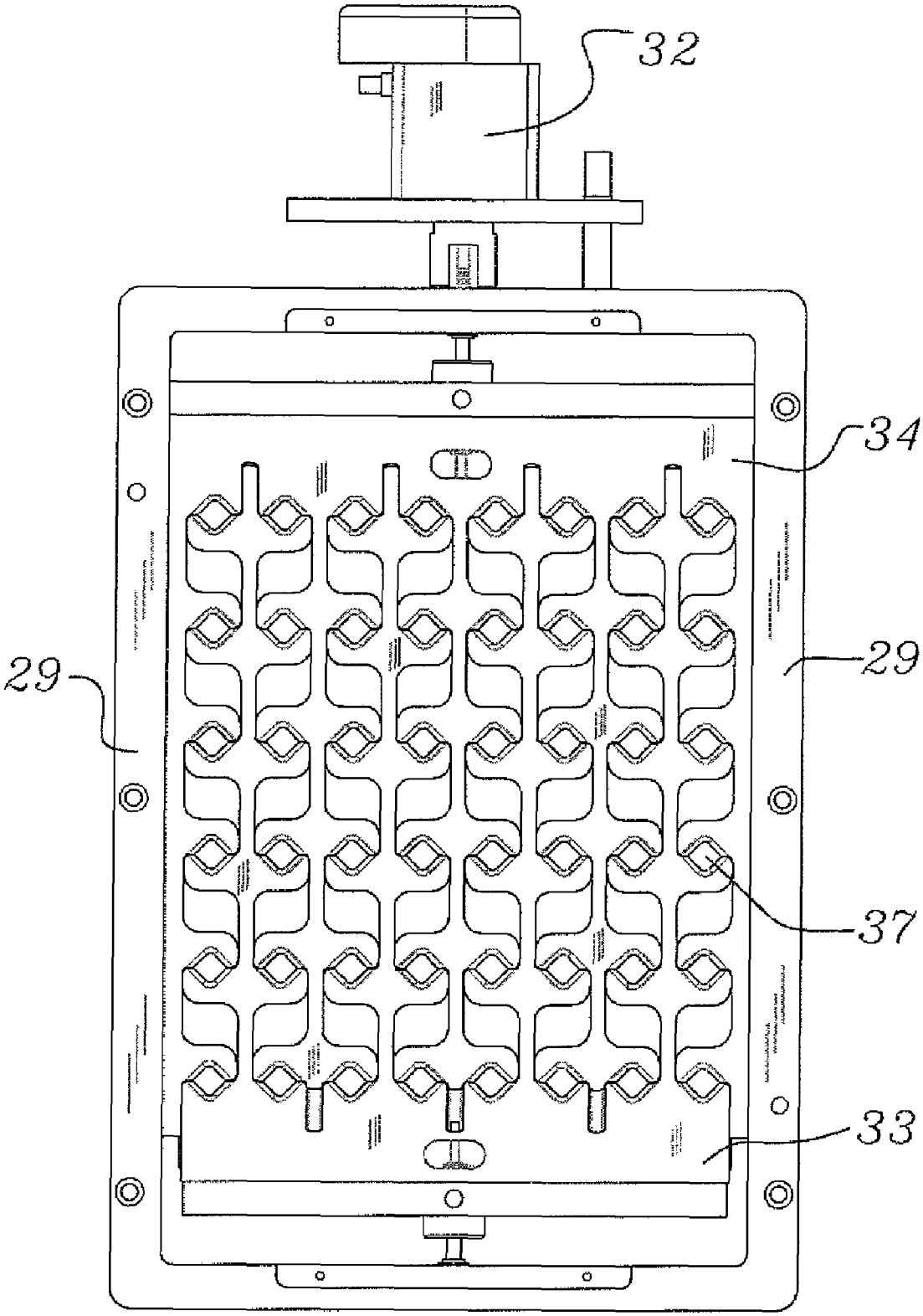
FIG. 7 is an elevated view of the adjustable transmission channels and/or cavities of the present invention shown partially in cross-section.

FIG. 7 illustrates the interlocking sidewall members 33, 34 secured within frame 29 wherein the interlocking sidewall members are adjusted to provide a smaller internal cavity dimension for the cavities 37. The spacing between the inner side walls of the interlocking sidewall members 33, 34 is adjusted by drive motor 32 which in the preferred exemplary embodiment is a screw type drive mechanism which provides inward and outward motion of the interlocking sidewall member 34 with respect to interlocking sidewall member 33.

Figure 8:
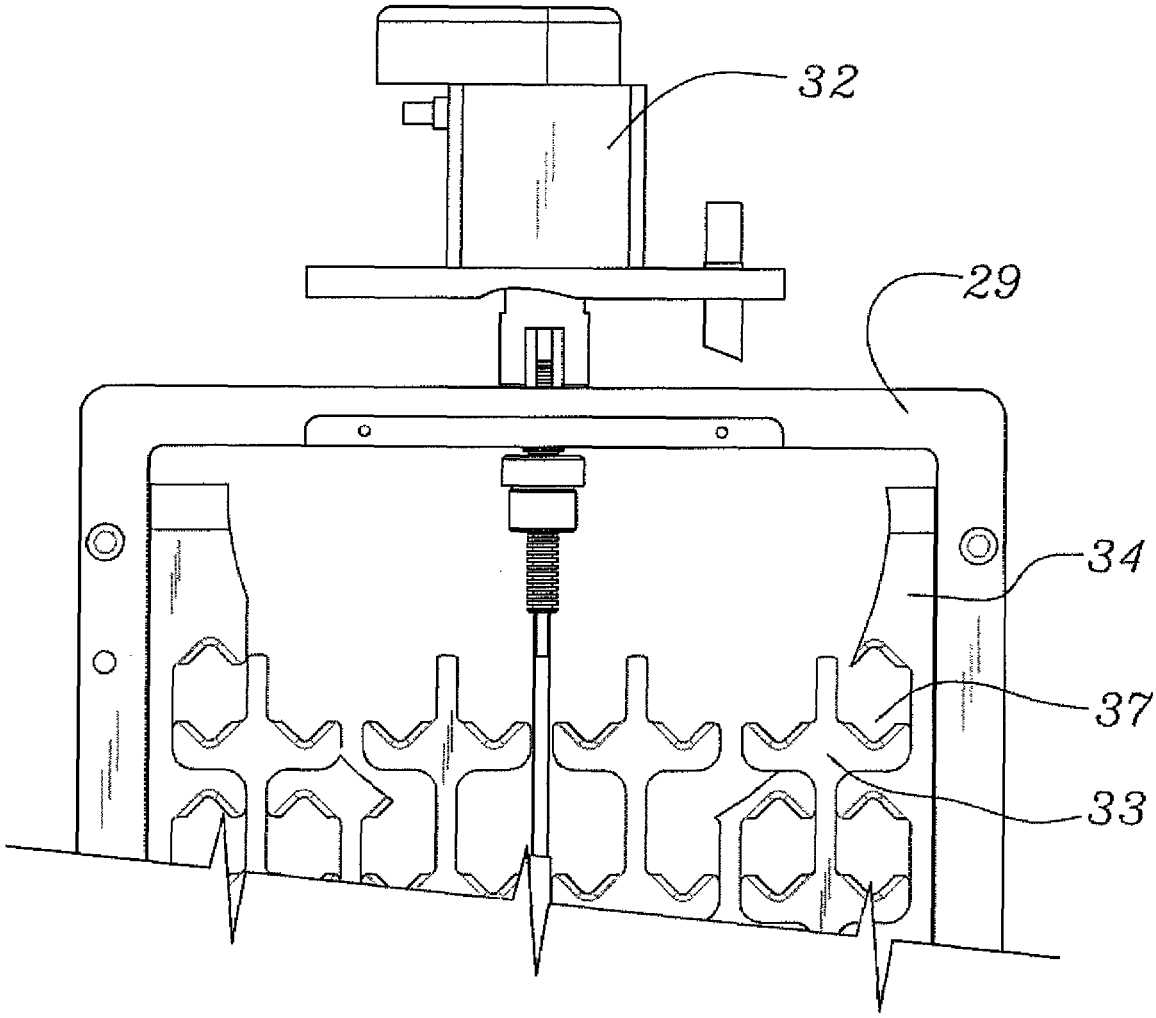
FIG. 8 is an elevated view of a portion of the adjustable transmission channels and/or cavities of the present invention shown partially in cross-section.

By adjusting the size of the medication apertures 37 different sized medications can be received and capsules can be preferably maintained in a generally vertical position. FIG. 8 illustrates an exemplary embodiment of a mechanism for altering the physical dimensions of the cavities 37 described above. As shown in FIG. 8 a drive motor 32 is provided for moving the interlocking sidewall structure 34 horizontally with respect to the interlocking sidewall structure 33 and the relative horizontal motion of these two structures alters the physical dimensions of the cavities 37 defined by the wall portions of the interlocking sidewall structures 33, 34. The altered cavity and or transmission channel dimensions are shown in FIGS. 6 and 7.

In the preferred exemplary embodiment, the relative motion of the interlocking sidewall members is provided by mechanically driving one of the interlocking sidewall members into the other. As noted above, various drive mechanisms may be utilized but is preferred that a screw drive mechanism is used so that various stopping positions can be achieved incrementally throughout the range of potential motion. At lease one of the interlocking sidewall structures 33, 34 may be provided with springs that bias its motion toward or away from the other interlocking sidewall structure. The drive motor 32 is then utilized to push against the spring biased action until the desired dimensions for the cavities 37 are achieved.

Those skilled in the art will recognize that virtually any type of drive mechanism may be utilized for adjusting the relative position of the interlocking sidewall structures 33, 34. Specifically, for example, pneumatic drives, hydraulic drives and electromechanical drive such as a solenoid may be used for physically altering the relative position of the interlocking structures. It should also be recognized that even manual adjustment of the two interlocking structures may be provided for the purpose of conveniently adjusting the physical dimensions of the cavities.

It should also be noted that the cavity space defined by the interlocking sidewall members may include a structure having openings corresponding to each of the cavities that is arranged beneath the cavities such that its horizontal displacement may be used to selectively drop solid products contained in the cavities. This can be achieved simply by sliding motion of a plate having openings corresponding to each of the cavities or it may also be achieved by having first and second adjustable cavity structures with one located directly beneath the other. The sliding motion of one relative to the other may be used to selectively release solid products from upper cavities to lower cavities as described in application Ser. No. 09/704,134 which does not incorporate the adjustable cavities of the present invention.

In accordance with a preferred exemplary embodiment of the present invention, the system which controls the physical dimensions of the cavity by driving the motor as desired is preferably controlled by a microprocessor. In such an embodiment, for example, when working with the robotic arm system referenced above and incorporated herein by reference, the adjustment of the physical dimensions for the cavities is made while the robotic arm is moving to grab the appropriate dispensing cassette. For example, when a larger pill is being accessed by the robotic arm, the microprocessor driven controller advantageously automatically adjusts the spacing so that the cavities are altered appropriately to correspond with the larger pill size. In such an embodiment, the robotic arm is then used to selectively position the dispensing cassette directly over the receiving cavities as noted in this earlier filed application. Thereafter, when smaller pills are being dispensed, the physical dimensions of the cavities may be reduced while the robotic arm is traversing to select an appropriate dispensing cassette containing a smaller solid pharmaceutical or nutraceutical product.

As noted above, one primary reason for utilizing the adjustable cavities of the present invention is so that elongated capsules may be maintained in a vertical orientation. This may be desired in order to facilitate improved throughput of the packaging machinery. Other applications and packaging machinery may utilize the system in another manner but still fall within the scope of the claims.

While the preferred embodiment of the present invention are shown and described, it is envisioned that those skilled in the art may devise various modifications of the present invention without departing from the spirit and scope of the appended claims.

What is claimed is:

1. An adjustable cavity member for use in connection with a medication dispensing apparatus, said adjustable cavity member comprising:

a first portion having a plurality of first interlocking side walls, the first interlocking side walls defining first side walls for a plurality of solid pharmaceutical passageways;

a second portion having a plurality of second interlocking side walls, the second interlocking side walls defining second side walls for the plurality of solid pharmaceutical passageways;

wherein said first interlocking sidewall portion and said second interlocking sidewall portion are positioned to provide a plurality of medication transmission channels defined by said first and second portions of interlocking side walls; and wherein the interlocking sidewalls of at least one of the first and second portions are movable relative to the other, the relative motion of the first and second interlocking sidewalls simultaneously altering a width of the plurality of medication transmission channels, the plurality of medication transmission channels being arranged in an array such that a direction of travel through the transmission channels is generally perpendicular to a direction of the relative motion between the first and second interlocking side walls.

2. The adjustable cavity member of claim 1, wherein said first portion having a plurality of first interlocking sidewalls includes a base member, at least one arm extending from said base member and a plurality of fingers extending from said at least one arm.

3. The adjustable cavity member of claim 2, wherein said first interlocking sidewalls walls are curved.

4. The adjustable cavity member of claim 2, wherein said first portion includes walls provided by said plurality of fingers.

5. The adjustable cavity member of claim 4, wherein a pneumatic drive pushes the first portion into the second portion.

6. The adjustable cavity member of claim 1, wherein said second portion having a plurality of second interlocking sidewalls includes a base member, at least one arm extending from said base member.

7. The adjustable cavity member of claim 1, further comprising springs to push at least one of said first or second portions outwardly away from an interlocking position.

8. The adjustable cavity member of claim 2, wherein said at least one arm of said first portion includes a spring receiving end and said second portion includes a receiving channel to receive said spring receiving end.

9. The adjustable cavity member of claim 8, further comprising an end plate mounted to said second portion and a spring positioned between said end plate and a spring receiving end.

10. The adjustable cavity member of claim 1, further comprising:

a first end plate mounted to said first portion;

at least one spring positioned between said fin end plate and said second portion.

* * * * *